US006085052A

United States Patent [19]

Yamane et al.

[11] Patent Number: 6,085,052

[45] Date of Patent: Jul. 4, 2000

[54] POSTURE-MAINTAINING PHOTOCOPIER IMAGING UNIT CASING

[75] Inventors: Naoki Yamane; Hiroaki Shiba; Yoshihisa Tanaka, all of Osaka, Japan

[73] Assignee: Mita Industrial Co., Ltd., Osaka, Japan

[21] Appl. No.: 09/350,186

[22] Filed: Jul. 9, 1999

[30] Foreign Application Priority Data

Jul. 13, 1998 [JP] Japan ..... 10-197250
Jun. 14, 1999 [JP] Japan ..... 11-166475

[51] Int. Cl.[7] ..... G03G 15/00

[52] U.S. Cl. ..... 399/111; 399/124; 399/358

[58] Field of Search ..... 399/111, 113, 399/110, 107, 124, 125, 120, 358, 359; 347/138, 152

[56] References Cited

U.S. PATENT DOCUMENTS

| | | | |
|---|---|---|---|
| 5,079,593 | 1/1992 | Satoh et al. | 399/111 |
| 5,081,495 | 1/1992 | Bellis | 399/111 |
| 5,105,221 | 4/1992 | Takahashi et al. | 399/111 |
| 5,606,406 | 2/1997 | Ikeyama et al. | 399/111 |
| 5,768,661 | 6/1998 | Coffey et al. | 399/111 |
| 5,848,342 | 12/1998 | Tanda | 399/358 |
| 5,890,034 | 3/1999 | Nakano et al. | 399/111 X |
| 5,953,561 | 9/1999 | Tashiro et al. | 399/111 |

*Primary Examiner*—Sophia S. Chen
*Attorney, Agent, or Firm*—Shinjyu, An Intellectual Property Firm

[57] ABSTRACT

A casing unitarily housing the photosensitive drum and developing device of a xerographic imaging system such that the thus composed imaging unit is retained in a predetermined operational position removably installed into a printing machine. The casing is configured such that when the imaging unit is removed from the printing machine, the imaging unit is retained in a posture equivalent to the predetermined operational orientation. Toner and developing agents are thus held in a steady state within the imaging unit, which particularly is an imaging unit in a lateral-transfer, vertical sheet-transport xerographic printing machine.

9 Claims, 9 Drawing Sheets

POSTURE-MAINTAINING PHOTOCOPIER IMAGING UNIT CASING

BACKGROUND OF THE INVENTION

1. Technical Field

The present invention relates to imaging units in electrostatographic/xerographic printing apparatuses. More specifically, the present invention relates to imaging units configured to be removable from a predetermined location in such printing apparatuses.

2. Description of Related Art

In electrostatographic/xerographic printing machines such as photocopiers, printers, and fax machines, a document is set onto a document table situated in the upper surface of the machine. Light is shined on the document image and the light reflected back from the document is used to read the document image. The image information thus read is used to form an electrostatic latent image on the surface of a photosensitive drum. Specifically, a main charging device is used to charge the photosensitive drum at a predetermined polarity, and when the drum is illuminated in accordance with the document image, charge in the illuminated portions is stripped, forming an electrostatic latent image.

A developing device, a transfer device, a separating device, and a cleaning device are disposed around the photosensitive drum.

The developing device contains toner that is charged with the same polarity as the photosensitive drum. In a neighboring position to the developing device and the photosensitive drum, the toner housed in the developing device adheres to the portions of the photosensitive drum that are not charged. Thus, the electrostatic latent image formed on the peripheral surface of the photosensitive drum is pictured into a toner image.

The transfer device applies a potential to the sheet being transported between the photosensitive drum and the transfer device. The potential, whose polarity is opposite that of the toner, is applied through the back of the sheet. This causes the toner on the peripheral surface of the photosensitive drum to be drawn to the sheet, thus transferring the toner image.

A separating device is disposed downstream the sheet transport path from the transfer device. The separating device attracts the back of the sheet away so that it does not wrap around the photosensitive drum. The separating device can be, for example, a separation needle to which a predetermined potential is applied.

In some electrostatographic/xerographic printing machines, the photosensitive drum and the developing device are housed unitarily inside a casing to form an imaging unit. The imaging unit is configured to be withdrawable with respect to the printing machine. Thus the unit can be pulled during maintenance, making the maintenance work simpler. Forming the photosensitive drum and the developing device unitarily is to ensure that the positional accuracy of the components relative to each other is not spoiled, in order not to invite degradation in image quality.

In imaging units such as those described above, the casing is often shaped to match the photosensitive drum, and the developer rollers, stirring paddles and spirals built into the developing device. Thus, the lower surface of the casing may not be formed as a horizontal plane. Wherein such an imaging unit has been pulled out from the printing machine, setting it onto a horizontal surface in the state in which it was housed within the printing machine is difficult. With the imaging unit housed in the printing machine, the toner and developing agent are set such that they remain in their steady state. Not being able to maintain the imaging unit in this state when it is taken out from the printing machine risks that the interior toner and developing agent will not be in their steady state.

Furthermore, the transfer device, which transfers the toner image formed on the peripheral surface of the photosensitive drum to the sheet, is disposed in the vicinity of or in contact with the peripheral surface of the photosensitive drum. Thus, the casing of the imaging unit must be open at least in the position where the transfer device is in the vicinity of or in contact with the photosensitive drum. In electrostatographic/xerographic printing machines in which sideways sheet transport paths are established, the transfer device is often disposed underneath the photosensitive drum. In such cases, the underside of the imaging unit casing is open. Wherein such an imaging unit is taken out of the printing machine, in setting the imaging unit on a horizontal surface, maintaining the state the imaging unit is in when housed in the printing machine is difficult. In particular, although the photosensitive drum is exposed on the underside of a casing thus configured, it should be kept from contacting anything while out of the machine.

SUMMARY OF THE INVENTION

An object of the present invention is to enable an imaging unit when removed from its electrostatographic/xerographic printing machine to set steadily, maintaining the state it is in housed within the printing machine.

An imaging unit embodied according to a first aspect of the present invention can be attached to and removed from a predetermined position in an image reproducing apparatus. The imaging unit comprises a photosensitive drum on the cylindrical surface of which electrostatic latent images can be formed; a developing device that pictures into toner images the electrostatic latent images on the circumferential periphery of the photosensitive drum; and a casing unitarily housing the photosensitive drum and developing device. The casing is configured to be installable into and removable from the predetermined position in the image reproducing apparatus. The casing, when removed from the image reproducing apparatus, is capable of maintaining the imaging unit in a posture equivalent to its predetermined orientation wherein it is installed in the image reproducing apparatus.

When the imaging unit is taken out of the image reproducing apparatus, it can stably maintain the orientation it had when in the image reproducing apparatus. This keeps the developing agent from clumping toward one side, or from spilling out, of the casing. Furthermore, when during maintenance a user mounts the imaging unit into the image reproducing apparatus main body, maintaining proper installation orientations is made easier, thus providing greater efficiency.

In another aspect of the present invention, the imaging unit casing includes especially configured support means. When the casing is taken out from the image reproducing apparatus, the support means retains the imaging unit in a posture equivalent to its predetermined orientation wherein it is installed in the image reproducing apparatus.

The imaging unit support means may be configured as a support surface formed on the bottom of the casing. This configuration provides a simple structure to ensure stability for the imaging unit when it is removed.

The support means may alternatively be collapsible talons mounted underneath the casing. The talons are mounted therein to be collapsible against the casing in removing or installing the imaging unit into the image reproducing apparatus. This makes removing and installing the imaging unit easier.

The support means may alternatively be ribs formed on the bottom of the casing, extending unidirectionally. This configuration ensures that the imaging unit can be set stably when removed from the image reproducing apparatus. In addition, the casing generally is molded from a synthetic polymer, and forming the casing with ribs helps to curtail warping that can take place when it is molded.

The support means may alternatively be a projection formed on the bottom surface of the casing. This configuration facilitates setting the imaging unit stably even if the surface on which the unit is mounted is not flat.

In yet another aspect of the invention, the imaging unit casing is configured to establish the center of gravity of the imaging unit such that when removed, the imaging unit is kept in a posture equivalent to its predetermined orientation in the image reproducing apparatus. At the same time, the configuration of the casing herein is so as not to hinder installation and removal of the imaging unit.

In a still further aspect, the imaging unit casing includes guide elements guided by corresponding guides provided in the image reproducing apparatus.

Wherein the imaging unit is for an image reproducing apparatus employing a laterally disposed transfer device together with a vertically situated sheet transport path for transferring the toner images from the photosensitive drum onto sheets, the casing may be configured to position the photosensitive drum accordingly for lateral image transfer.

In a yet another aspect of the present invention, the imaging unit casing is configured as a framework for housing the developing unit, and for housing and meanwhile partially supporting the photosensitive drum therein.

Furthermore, the imaging unit casing may be configured as a first framework that supports and meanwhile houses the photosensitive drum, and a second framework that houses the developing unit, wherein the first framework and the second framework are pivotably coupled together.

An imaging unit casing configured according to the present invention keeps the internal developing agents and toner in a steady state, and at the same time prevents damage to the exposed cylindrical surface of the photosensitive drum.

The foregoing and other objects, features, aspects and advantages of the present invention will become more apparent from the following detailed description in conjunction with the accompanying drawings.

DETAILED DESCRIPTION OF THE PREFERRED EMBODIMENTS

Figure 1:
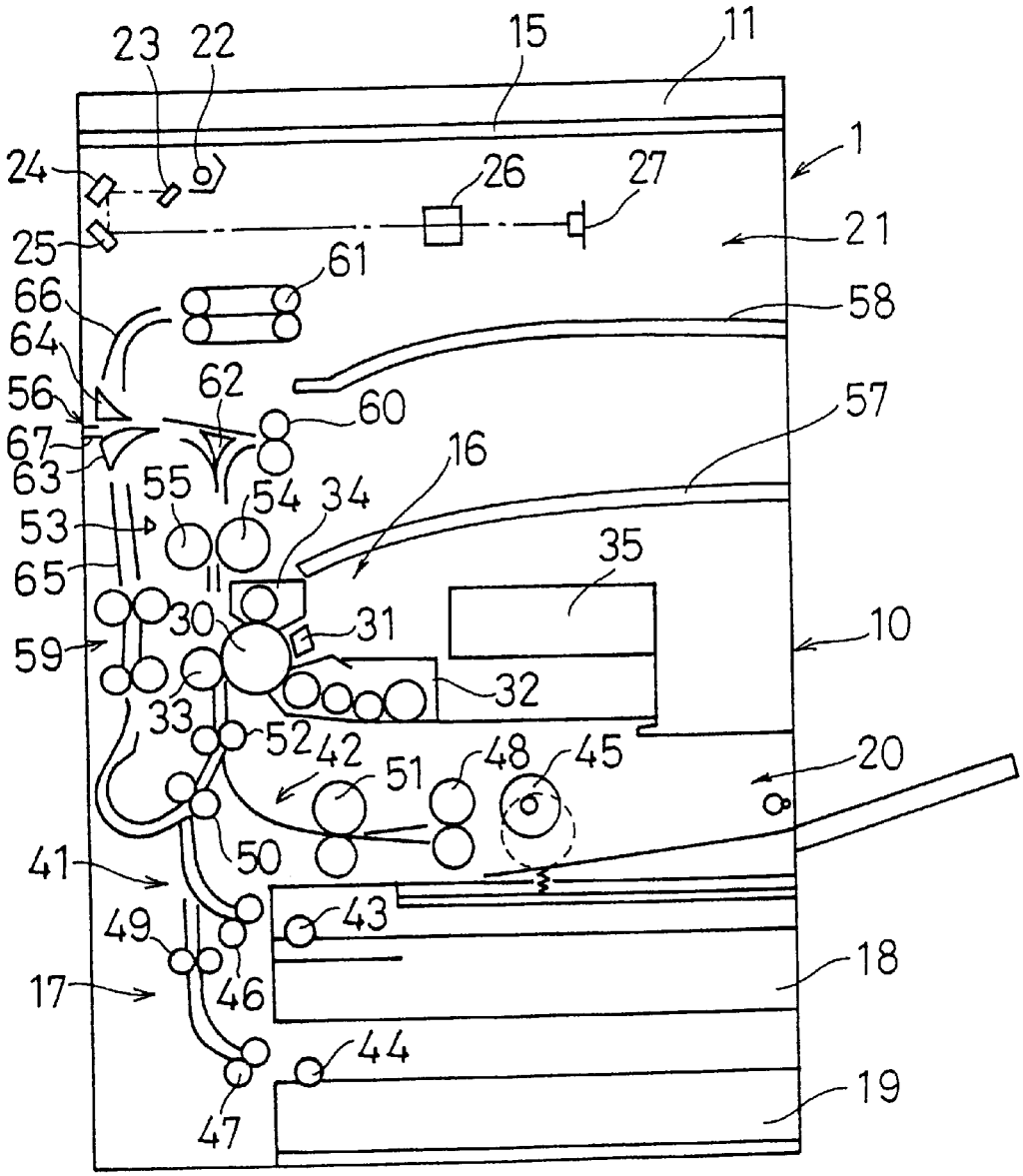
FIG. 1 is a schematic sectional elevation of a photocopier in which an imaging unit embodied in accordance with the present invention may be implemented.

FIG. 1 is a vertical cross-section view of a photocopying machine in which an embodiment of the present invention can be implemented.

The photocopier 1 includes a main unit 10 and a document holder 11 hinge-mounted over the main unit 10.

A document table 15, on which documents can be set, is disposed in the upper portion of the main unit 10. An image reproducing section 16 is disposed in the main unit 10 on the left side when the device is viewed from the front, and roughly midway vertically. At the lower portion of the main unit 10 is disposed a sheet-feeding section 17 for feeding sheets to the image reproducing section 16.

The paper-feeding section 17 is removably attached to the main unit 10 and includes sheet-feeding cassettes 18, 19 for housing sheets, and a stack bypass 20 disposed above the sheet-feeding cassettes 18, 19.

An optical system 21 for reading image information from a document set on the document table 15 is disposed below the document table 15. The optical system 21 includes a light-source 22 for shining light on the surface of the document set on the document table 15; mirrors 23, 24, 25, for deflecting light reflected from the document surface; a lens 26 for focusing light from the mirror 25; and an image sensor 27, such as a CCD sensor, that receives the light focused by the lens 26 and generates an image data signal corresponding to the document image.

The image reproducing section 16 includes a photosensitive drum 30 having a surface on which is formed an electrostatic latent image. The image reproducing section 16 also includes, disposed around the photosensitive drum 30, a main charging device 31, a developing device 32, a transfer roller 33, and a cleaning device 34.

The main charging device 31 is a device for charging the surface of the photosensitive drum 30 and is disposed diagonally upward to the right from the photosensitive drum 30. A developing device 32, which forms a toner image on the photosensitive drum 30, is disposed at a predetermined distance away from the main charging device 31 and diagonally downward to the right from the photosensitive drum 30. The developing device 32 contains toner and forms a toner image from the electrostatic latent image on the photosensitive drum 30. The transfer roller 33 is for transferring toner images on the photosensitive drum 30 to sheets, and is disposed to the left of the photosensitive drum 30. The cleaning device 34 is disposed above the photosensitive drum 30 for removing residual toner and the like from the peripheral surface thereof. Toner thus recovered is transported to the developing device 32 via a toner transport device 71, depicted in FIG. 2 and described later.

To the right of the photosensitive drum 30 is disposed a laser unit 35, which forms an electrostatic latent image on the peripheral surface of the photosensitive drum 30. The laser unit 35 uses the image data signal obtained from the image sensor 27 to form an electrostatic latent image on the peripheral surface of the photosensitive drum 30.

In the sheet-feeding section 17, there is disposed a vertical transport path 41 for transporting a sheet from the sheet-feeding cassettes 18, 19 toward the image reproducing section 16, as well as a bypass transport path 42 for transporting sheets from the stack bypass 20 toward the image reproducing section 16. On the sheet-feeding cassettes 18, 19 and the stack bypass 20 are disposed pickup rollers 43, 44, 45, which take out sheets loaded therein; and sheet-feeding roller pairs 46, 47, 48, which send out sheets one at a time to the respective transport paths 41 and 42. Transport roller pairs 49, 50 are disposed on the vertical transport path 41, and a transport roller pair 51 is disposed on the bypass transport path 42. The vertical transport path 41 and the bypass transport path 42 join below the transfer position, which is where the photosensitive drum 30 and the transfer roller 33 oppose each other. A resist roller 52 is disposed at the position where the two paths join for holding a transported sheet in standby at a predetermined position.

A fixing device 53 is disposed above the photosensitive drum 30 and the transfer roller 33 to fuse fix the transferred toner to the sheet. A heating roller 54, which contains a heater, and a pressure roller 55, which presses against the heating roller 54, are disposed in the fixing device 53. The sheet is nipped and transported between these rollers to heat and fuse the toner image formed on the surface of the sheet.

A branching section 56 is disposed above the fixing device 53.

To the right of the branching section 56 is an output tray 57, into which sheets transported by a discharge roller pair 60 are discharged. Above the output tray 57 is a sub-output tray 58, into which sheets transported by a discharge roller pair 61 are discharged. Below and to the left of the branching section 56 is a switchback section 59, which sheets flips over when the photocopier carries out double-sided copying. A branching claw 62 is disposed at the branching section 56 to switch the sheet transport path between the output tray 57 and the switchback section 59. Two branching claws 63, 64 are disposed to the left of the branching claw 62. Below these two branching claws 63, 64 is disposed a switchback transport path 65, which guides the sheet to the switchback section 59. Above the two branching claws 63, 64 is a sub-tray transport path 66, which guides sheets to the sub-output tray 58. Interposed between the two branching claws 63, 64 is a finisher transport path 67, which transports the sheet to finishers such as a sorter or a stapler-sorter (not shown in the figures). The branching claws 63, 64 switch the path of the transported sheet to either the switchback transport path 65, the sub-tray transport path 66, or the finisher transport path 67.

Figure 2:
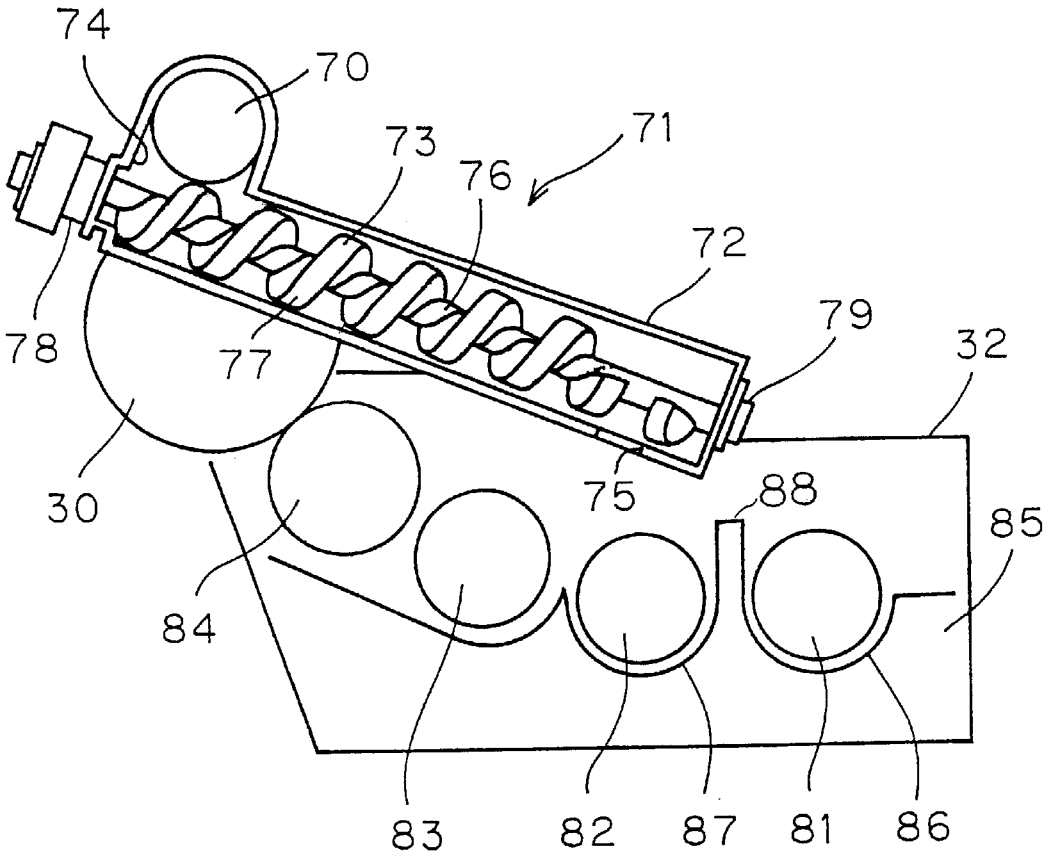
FIG. 2 is a sectional view of a toner transport device of the imaging unit out of the photocopier, with other components of the unit depicted schematically.

Referring now to FIG. 2, the cleaning device 34 includes a cleaning blade (not shown) and a spiral 70. The cleaning blade presses against the peripheral surface of the photosensitive drum 30 to scrape off residual toner. The spiral 70 transports toner thus recovered to an end in the width direction of the cleaning device 34, wherein the toner transport device 71 is disposed.

The toner transport device 71 includes a toner transport container 72, shaped as a hollow tube, and a transport member 73 rotatably disposed in the toner transport container 72.

An opening 74 formed in the toner transport container 72 is continuous with that end along the width direction of the cleaning device 34 where the toner transport device 71 meets the spiral 70. In addition, a discharge port 75, through which toner is discharged into the developing device 32, is also formed in the toner transport container 72.

The transport member 73 comprises a rotational shaft 76 and a fitted-contact element 77 provided in a spiral shape on the periphery of the rotational shaft 76. The fitted-contact element 77 is formed as brushes projecting from the rotational shaft 76. The brushes are formed of a synthetic resin (polymer) fiber. The fitted-contact element 77 is accordingly disposed such that the brush ends are in contact with the inner wall of the toner transport container 72.

The rotational shaft 76 is supported on bearings 78, 79 disposed at the longitudinal ends of the toner transport container 72. The rotational shaft 76 is rotated by driving means not shown in the figure.

Residual toner scraped away from the peripheral surface of the photosensitive drum 30 by the cleaning blade is transported to the toner transport device 71 by the spiral 70 and drops through the opening 74 onto the transport member 73 in the toner transport container 72.

By rotating the transport member 73, the spiral 70 transports toner such that the toner travels through the toner transport container 72 rightward in the figure. The toner is then discharged into the developing device 32 through the discharge port 75.

The synthetic polymer constituting the brush forming the fitted-contact element 77 of the transport member 73 has elasticity. Accordingly, since the fitted-contact element 77 slides against the inner wall of the toner transport container 72 while transporting toner, the inner wall is continuously cleaned by the brush ends of the fitted-contact element 77. This furthermore prevents toner from sticking to the inner wall of the toner transport container 72. Moreover, by the elasticity of the brush, the fitted-contact element 77 is kept under elastic deformation as it is rotated. This makes it difficult for the toner to stick to the surface of the fitted-contact element 77. Even if toner does stick, the elastic deformation will cause it to come off easily. Thus, toner is prevented from sticking together and forming large clumps that would clog the toner transport container 72. Therefore, toner transport in the toner transport device 71 is kept efficient.

Figure 3:
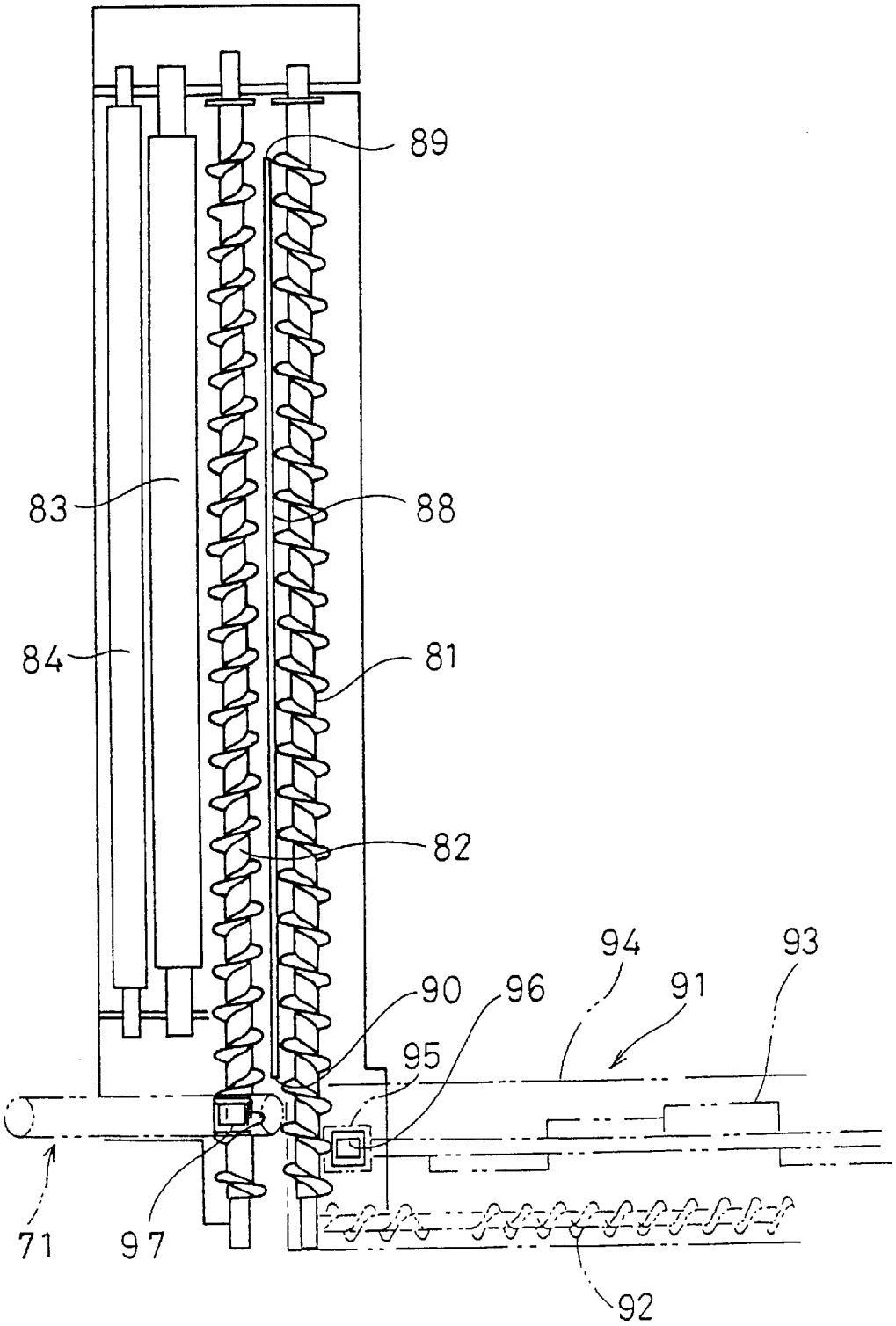
FIG. 3 is a plan view of a developing device of the imaging unit, with the toner transport device and a toner cartridge thereof in phantom indicated partially.

The developing device 32 includes a casing 85, as shown in FIG. 2. As shown in FIG. 3, the casing 85 contains two spirals 81, 82, a stirring paddle 83, and a developing roller 84.

The casing 85 is formed with channels 86, 87, in which the spirals 81, 82 are disposed. The channels 86, 87 form transport paths in which toner and its carrier are stirred and transported by the spirals 81, 82. In the channel 86, the rotation of the spiral 81 transports carrier and toner upward in FIG. 3. In the channel 87, the rotation of the spiral 82 transports the carrier and the toner downward in FIG. 3. A partition wall 88 is formed between the channels 86 and 87 to separate the two transport paths. The partition wall 88 is formed with cutout sections 89, 90, which connect the two channels 86 and 87. Thus, the carrier and toner transported by the spirals 81, 82 is circulated through the channel 86 and 87 while being stirred.

The developing device 32 includes a removable toner cartridge that contains toner for supply to the developing device 32. The toner cartridge 91 includes a casing 94 containing a spiral 92 and a stirring paddle 93. A toner discharge port 95 is formed in the casing 94 to discharge toner.

A toner replenishing port 96 is formed in the casing 85 of the developing device 32 for alignment with the toner discharge port 95 of the toner cartridge 91. The toner replenishing port 96 is disposed above the channel 86 for the spiral 81.

A recovered toner replenishing port 97 formed in the casing 85 of the developing device 32 at a position for alignment with the discharge port 75 of the toner transport device 71. The recovered toner replenishing port 97 is disposed above the channel 87 for the spiral 82 and is positioned adjacent to the cutout 90.

The recovered toner transported by the toner transport device 71 drops down onto the spiral 82 via the recovered toner replenishing port 97. The recovered toner drops down to the lower end (in FIG. 3) of the spiral 82. The transport direction of the spiral 82 goes from top to bottom in FIG. 3, so the recovered toner dropped onto the spiral 82 is immediately transported through the cutout section 90 to the channel 86 for the spiral 81.

Here, the recovered toner is mixed together with toner supplied from the toner cartridge 91 through the toner replenishing port 96, and the spiral 81 stirs it together with carrier while transporting it from bottom to top in FIG. 3. The carrier and toner that has been transported to the top by the spiral 81 is transported to the channel 87 via the cut-out section 89, where it is stirred further by spiral 82 as it is transported through the channel 87.

A portion of the carrier and toner transported through the channel 87 overflows toward the stirring paddle 83. The stirring paddle 83 takes this toner and transports it toward the developing roller 84. The toner adheres to the developing roller 84 for picturing the electrostatic latent image borne circumferentially on the photosensitive drum 30 into a toner image.

Resources can be used efficiently since recovered toner retrieved by the cleaning device 34 is directly transported to the developing device 32. Also, two spirals 81, 82 are disposed in the developing device 32, onto which recovered toner retrieved from the cleaning device 34 is dropped. This allows efficient mixing of carrier and toner. In the carrier and toner transport paths formed by the spirals 81, 82, the recovered toner replenishing port 97 is disposed upstream from the replenishing port 96, which supplies new toner from the toner cartridge 91. Thus, recovered and new toner can be stirred thoroughly by the spirals 81, 82, thus preventing degradation in image quality.

The toner cartridge 91 can be shifted between a set position (FIG. 3), wherein the discharge port 95 is aligned with the toner replenishing port 96 of the developing device 32, and a withdrawn position to the right of the set position in FIG. 3. The toner cartridge slides along a guide member not shown in the figure.

Figure 4:
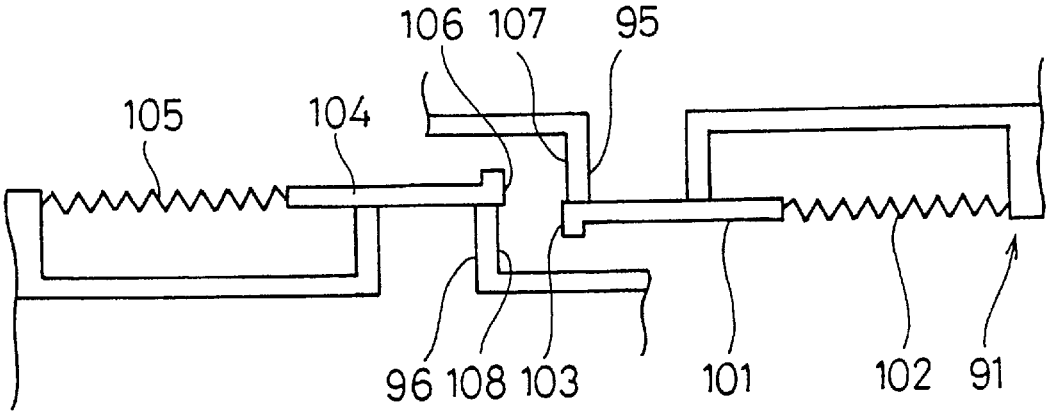
FIG. 4 is a schematic fragmentary view of corresponding mechanisms for interlocking a discharge port of the toner cartridge and a replenishing port of the developing device.

As shown in FIG. 4, a first sliding plate 101 is attached to the toner cartridge 91, and is urged by a spring 102 in the direction in which it covers the discharge port 95. The right end of the first sliding plate 101 forms an operating tab 103 that can be brought into contact with part of the developing device 32.

A second sliding plate 104 is attached to the developing device 32 in the vicinity of the toner replenishing port 96, and is urged by a spring 105 in the direction in which it covers the toner replenishing port 96. The left end of the second sliding plate 104 forms an operating tab 106 that can come into contact with part of the toner cartridge 91.

A position limiter 107 is formed at the left of the outer surface of the discharge port 95 of the toner cartridge 91. The position limiter 107 comes into contact with the operating tab 106 and causes the second sliding plate 104 to slide. On the right of the outer surface of the toner replenishing port 96 of the developing device 32, there is disposed a position limiter 108, which comes into contact with the operating tab 103 of the first sliding plate 101 to slide the first sliding plate 101.

If the toner cartridge 91 is not at the set position, the sliding plate 101, as shown in FIG. 4, is urged by the spring 102 to the left in FIG. 4 so that the discharge port 95 is sealed. The second sliding plate 104 is urged to the right in the figure by the spring 105 so that the toner replenishing port 96 is sealed.

Figure 5:
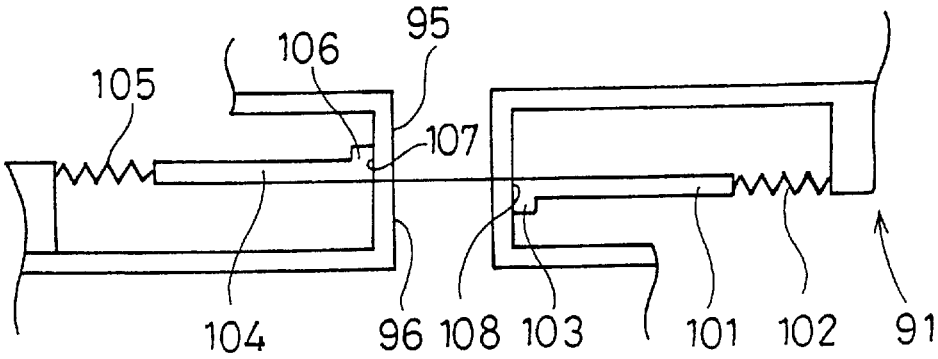
FIG. 5 is a view corresponding to FIG. 4, wherein the mechanisms are shown interlocked.

When the toner cartridge 91 is slid to the set position to the left in the figure, as shown in FIG. 5, the operating tab 103 of the first sliding plate 101 comes into contact with the position limiter 108 of the developing device 32, causing a rightward movement in opposition to the force of the spring 102, thus opening the discharge port 95 of the toner cartridge 91. At the same time, the operating tab 106 of the second sliding plate 104 comes into contact with the position limiter 107 of the toner cartridge 91, causing leftward movement in opposition to the force of the spring 105, thus opening the toner replenishing port 96 of the developing device 32. As a result, the discharge port 95 of the toner cartridge 91 and the toner replenishing port 96 of the developing device 32 are made continuous, and toner can be fed from the toner cartridge 91 to the developing device 32.

When the toner cartridge 91 is moved to the withdrawn position in order to replace it for example, the toner cartridge 91 is displaced to the right from the state shown in FIG. 5. The first sliding plate 101 is released from the position limiter 108 and the pull from the spring 102 causes it to move to the left, thus covering off the discharge port 95 of the toner cartridge 91. At the same time, the second sliding plate 104 is released from the position limiter 107 and moves to the right due to the pull from the spring 105, thus sealing the toner replenishing port 96 of the developing device 32.

When the toner cartridge 91 is moved from the predetermined set position, the discharge port 95 of the toner cartridge 91 is sealed by the first sliding plate 101, and the toner replenishing port 96 of the developing device 32 is sealed by the second sliding plate 104. This prevents toner from spilling out. When maintenance is to be performed, much toner may remain inside the toner cartridge 91, and this prevents the toner from spilling out when the toner cartridge 91 is at the withdrawn position.

It would also be possible to have a separate position limiter disposed on the developing device for being brought into contact with the operating tab 103 of the first sliding plate 101. A separate position limiter for being brought into contact with the operating tab 106 of the second sliding plate 104 may also be provided on the toner cartridge 91.

In the above description, the toner cartridge 91 is attached directly to the developing device 32. However, it would also be possible to use a similar structure for a device where the developing device includes a toner hopper for supplying toner and where the toner cartridge can be attached and removed from this toner hopper.

Figure 6:
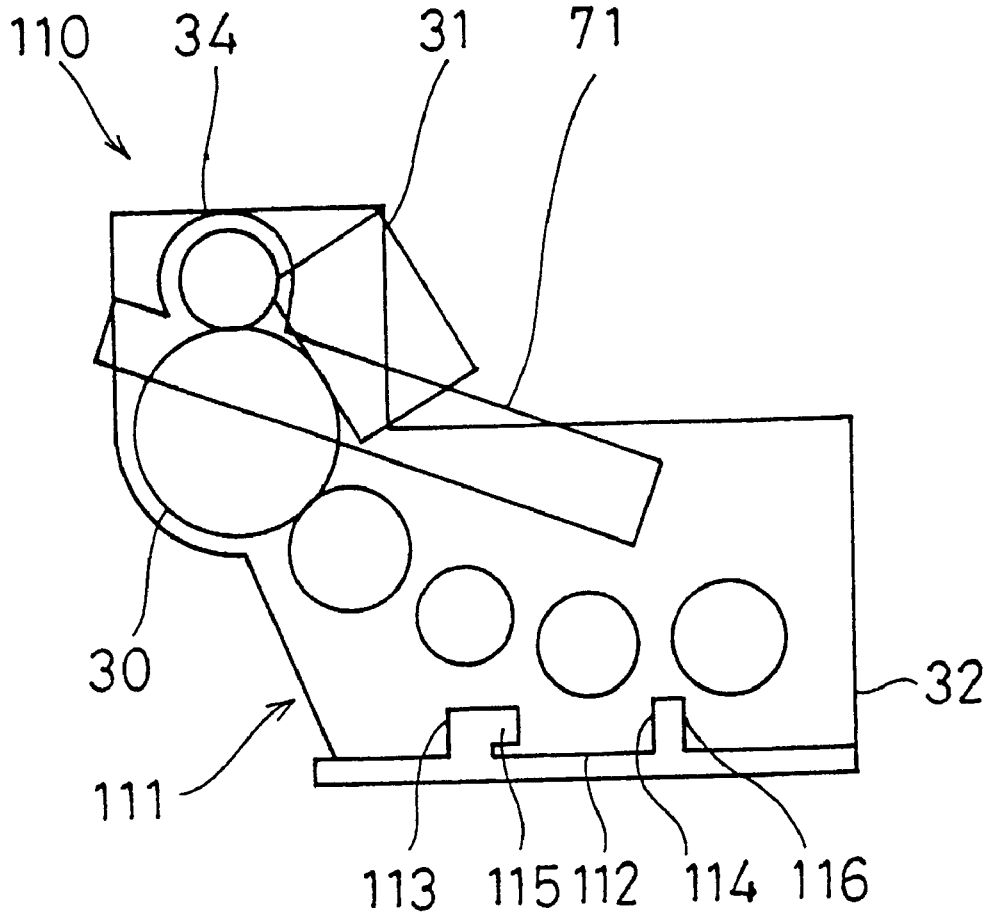
FIG. 6 is a schematic representation corresponding to FIG. 2 for describing a casing of the imaging unit, shown installed on a guide.

As shown in FIG. 6, an imaging unit 110 in accordance with the present invention includes the following elements held integrally in a casing 111: the photosensitive drum 30, the main charging device 31, the developing device 32, the cleaning device 34, and the toner transport device 71. The portion of the casing 111 surrounding the developing device 32 forms a developing unit casing 85 for the developing device 32. The lower surface of the casing 111 includes a bottom surface 112 that forms a horizontal surface when housed in the copier 1. Guide grooves 113, 114 are formed on the bottom surface 112 perpendicular to the plane of the FIG. 6 drawing sheet. In the copier 1, guide members 115, 116 are formed perpendicular to the plane of the FIG. 6 drawing sheet. The guide grooves 113, 114 of the imaging unit 110 fit together with the guide members 115, 116, thus allowing the imaging unit 110 to travel perpendicular to the plane of the FIG. 6 drawing sheet.

The imaging unit 110 is guided by guide members 115, 116 and can be drawn out to the front of the copier 1 (perpendicular to and above the plane of the FIG. 6 drawing sheet). The imaging unit 110 drawn out from the copier 1 can be set on a horizontal surface using the bottom surface 112 of the casing 111. Thus, when the imaging unit 110 is drawn out from the copier 1, it can be set on a horizontal surface while maintaining the same orientation that it was in when housed in the copier 1. This keeps the toner and developing agents housed therein in a steady state. Furthermore, damage to the exposed peripheral surface of photosensitive drum 30 is prevented. Also, since there is no need for elements to project downward or outward in other directions, the imaging unit 110 can be attached and removed easily while avoiding damage to other parts and to the user.

In the embodiment described above, the bottom surface 112 of the casing 111 serves as support means to allow the casing 111 to be kept in the same orientation as it was inside the copier when it is taken out from the copier. The bottom surface 112 of the casing 111 forms a horizontal plane. When the casing 111 is removed from the copier and placed on a table or the like, the bottom surface 112 allows it to be kept in the same orientation as when it was inside the copier.

Figure 7:
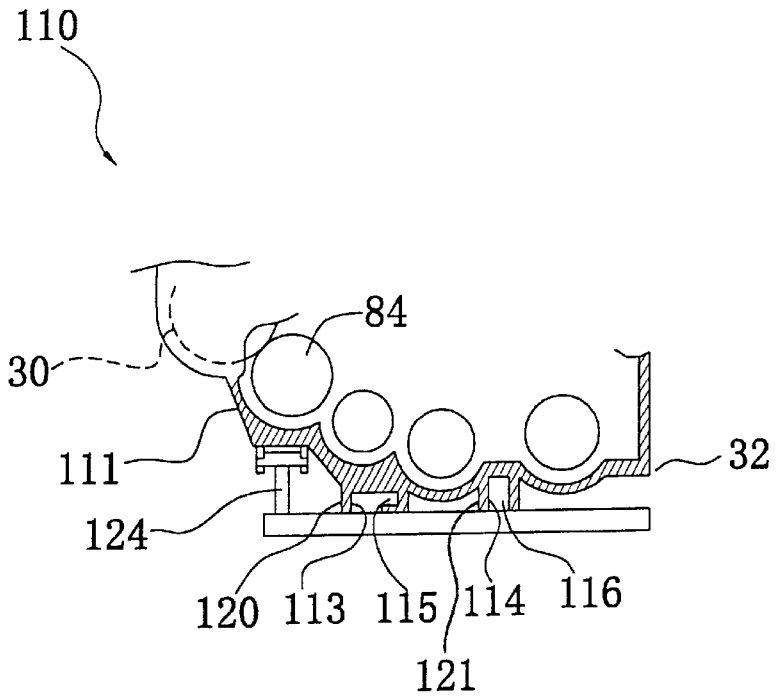
FIG. 7 is a schematic, fragmentary and partially cut away section view corresponding to FIG. 6 in another embodiment of the imaging unit.

However, various other structures can be used for support means. FIG. 7 shows one example. In the example shown in FIG. 7, the bottom surface of the casing 111 is formed with curved surfaces extending in conformity with components housed in the casing. Projections 120, 121 are formed on a section of the bottom surface, and grooves 113, 114 are formed in the projections 120, 121 to fit guide members 115, 116.

Figure 8:
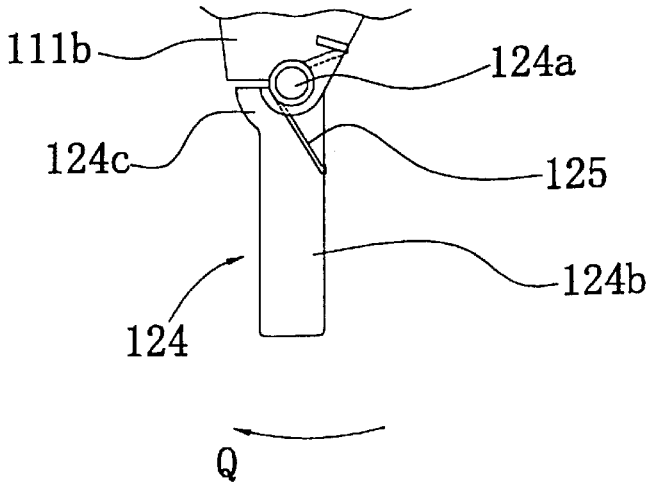
FIG. 8 is an enlarged, lateral view of a portion from FIG. 7.

Talons 124 are disposed on a bottom-directed portion of the casing 111. Two talons 124 are disposed beneath the developer roller 84 parallel to the axis of the developer roller. (FIG. 7 shows only the talon 124 disposed toward the front.) FIG. 8 shows an enlarged lateral view of one of the talons 124. Each talon 124 includes a pivot 124*a* pivotably supported by a pair of supports 111*b* formed on the bottom surface of the casing 111, and a main talon element 124*b* extending downward from the pivot 124*a*. The length of the main talon element 124*b* is determined such that its bottom end is at the same height as the bottom ends of the projections 120, 121. The talons 124 are configured with a helical spring 125 disposed around the pivot 124*a* continuously acting on the talons 124 in the direction indicated by the arrow Q shown in FIG. 8. A stopper 124*c* formed on the upper end of the main talon element 124*b* comes into contact with a section of the support 111*b* so that the talon 124 is kept extended vertically downward.

With the talons 124 thus disposed, the imaging unit 110 can be removed from the copier 1 and placed on a table or the like meanwhile maintaining the same orientation as when it was housed in the copier. The talons 124 can pivot in the direction opposite to the arrow Q in FIG. 8. Thus, when the imaging unit 110 is being taken out of the copier 1, if the lower portion of the talons 124 come into contact with the frame of the copier 1, the talons 124 pivot in opposition to the spring 115, thus enabling the imaging unit 110 to be drawn out smoothly. Once the imaging unit 110 has passed any obstructing section of the frame, the spring 115 restores the talons 124 to state shown in FIG. 8 so that the talons 124 can serve as support means when the imaging unit 110 is set on a table or the like.

Figure 9:
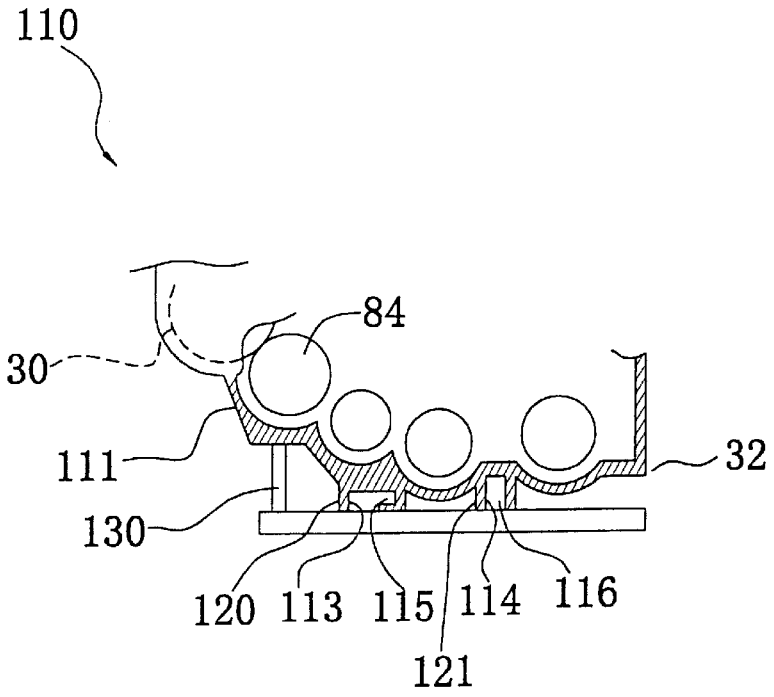
FIGS. 9 and 10 are views each corresponding to FIG. 7 in respective further embodiments of the imaging unit.

FIG. 9 shows another example of support means.

As with the casing shown in FIG. 7, the bottom surface of the casing 111 of the imaging unit 110 shown in FIG. 9 curves in conformity with the inner components. As with the example described above, downwardly projecting projections 120, 121 are disposed on the bottom surface of the casing 111, and grooves 113, 114 are formed in the projections 120, 121 for the guide members 115, 116.

Although only one is shown in FIG. 9, a plurality of legs (projections) 130 is formed integrally with the bottom surface of the casing 111. The legs 130 extend downward from beneath the developer roller 84 and are disposed at a predetermined intervals along the axis of the developer roller 84. The length of the legs 130 is determined so that their bottom ends are at the same height as the bottom ends of the projections 120, 121.

By providing the plurality of legs 130 as described above, the imaging unit 110 can be taken out of the copier 1 and placed on a table or the like meanwhile maintaining the same orientation it had when it was in the copier 1.

Figure 10:
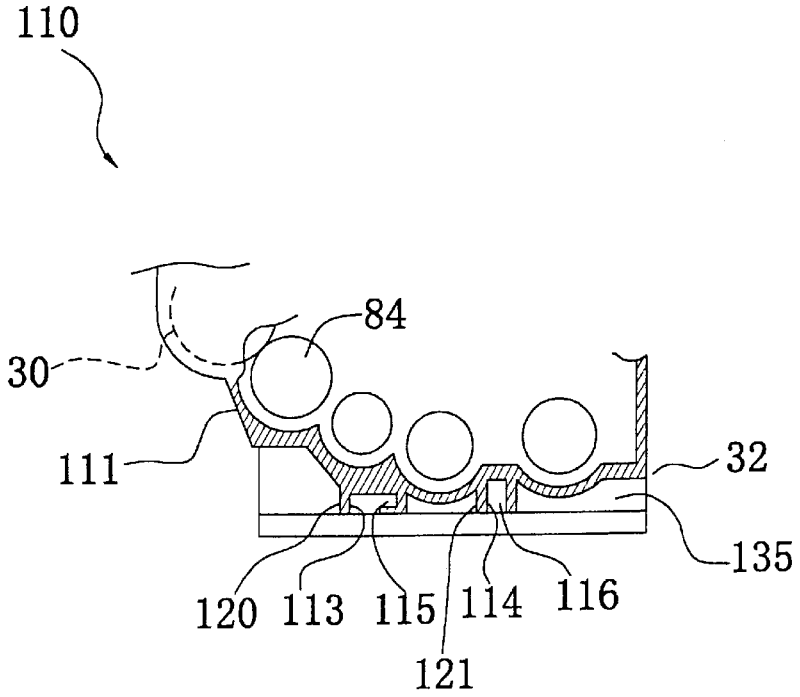
Figure 11:
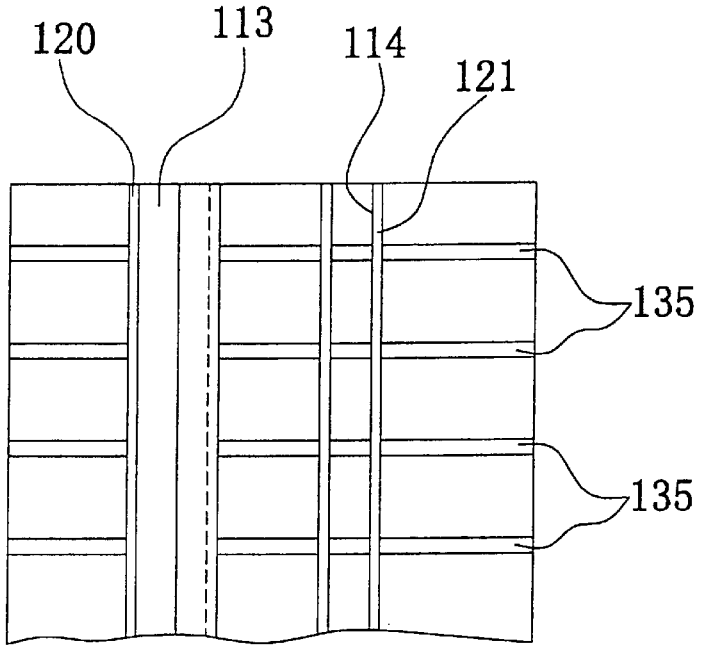
FIG. 11 is a fragmentary bottom view of the imaging unit depicted in FIG. 10.

Yet another example of supporting means is shown in FIG. 10 and FIG. 11.

As with the examples described above, the bottom surface of the casing 111 for the imaging unit 110 from this example is formed as a curved surface extending in conformity with the internal components. Projections 120, 121 project downward from the bottom surface of the casing 111, and grooves 113, 114 for the guide members 115, 116 are formed in the projections 120, 121.

As indicated in FIG. 11, which shows the bottom surface of FIG. 10, a plurality of ribs 135 are formed on the bottom surface of the casing 111. The ribs 135 extend in a direction substantially perpendicular to the grooves 113, 114. The height of these ribs 135 is determined so that the bottom ends of the ribs 135 are at the same height as the bottom ends of the projections 120, 121.

By providing a plurality of ribs 135 in this manner, the imaging unit 110 can be taken out from the copier 1 and placed on a table or the like meanwhile maintaining the same orientation as when it was inside the copier, and the imaging unit 110 is kept in a steady state.

Figure 12:
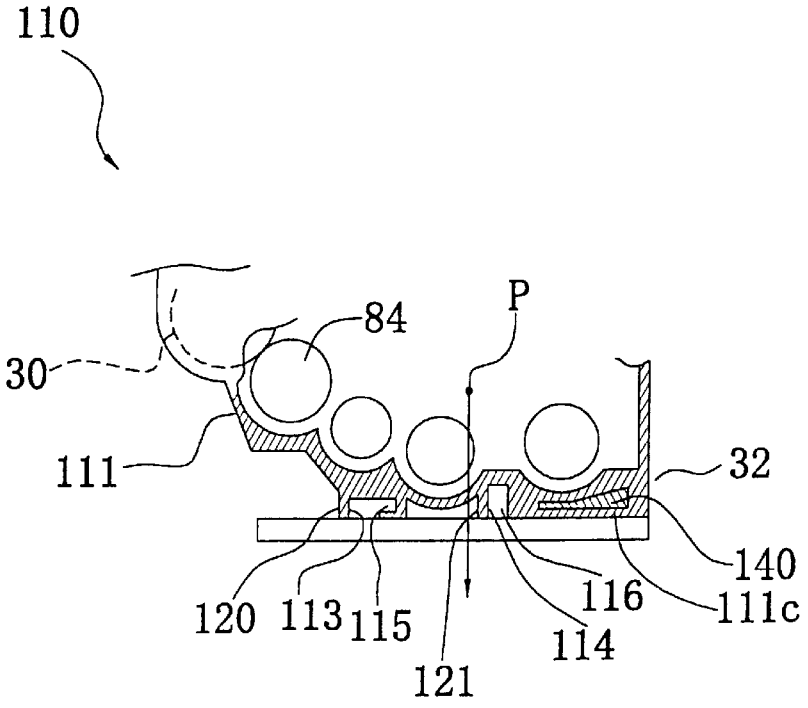
FIG. 12 is a view corresponding to FIG. 7 in a still further embodiment of the imaging unit.

FIG. 12 shows yet another example of support means.

In this example, a section of the bottom surface of the casing is molded from a metal having a higher specific gravity than the other synthetic polymer- (resin)-molded sections. This enables the center of gravity of the entire imaging unit 110 to be adjusted. More specifically, a metal element 140 is molded into a portion of the casing 111 resin at an end 111*c* of the bottom surface of the casing 111 opposite the photosensitive drum 30. The bottom surface of the end 111*c* is determined to be at the same height as the projections 120, 121, which herein are also formed with grooves 113, 114 for the guide members 115, 116.

In this casing 111 configuration, the absence of the metal member 140 would place the center of gravity toward the photosensitive drum 30, such that when the imaging unit 110 is taken out of the copier 1 and placed on a table or the like, the imaging unit 110 would not maintain the same orientation it had when it was in the copier. The imaging unit 110 would be placed on the table with the section below the developer roller 84 touching the table surface.

However, in this example, the metal member 140 is embedded at the end 111*c* so that the overall center of gravity of the imaging unit 110 is situated at the position P shown in the figure. Thus, when the imaging unit 110 is taken out of the copier 1 and placed on a table or the like, it is able to maintain the same orientation as when it was in the copier 1—without the need, as with the examples described above, for projections and supporting means such as the talons 124.

Instead of using the metal member 140, it would also be possible to adjust the position of the center of gravity by adjusting the arrangement of members inside the casing 111. This would result in a lighter imaging unit 110.

In each of the aforesaid embodiments, examples in which the casing 111 is formed of a single framework was explained, but the form of the casing 111 is not limited to the aforesaid embodiments. In the example shown in FIG. 13, developing unit 150 and photosensitive drum unit 151 constitute the imaging unit 110. For the developing unit 150 a first framework 152 is provided that houses and at the same time rotatably supports the developing roller 84, spirals and like components. Further, for the photosensitive drum unit 151, a second framework 153 is provided that houses and at the same time rotatably supports the photosensitive drum 30, the transfer roller 33, and like components. Accordingly, the first framework 152 and the second framework 153 constitute the casing of the imaging unit 110. Furthermore, the first framework 152 and the second framework 153 are pivotably coupled by a pivotable support 154. Moreover, the two frameworks 152, 153 are urged by a spring 155 in the direction in which they approach mutually.

Figure 13:
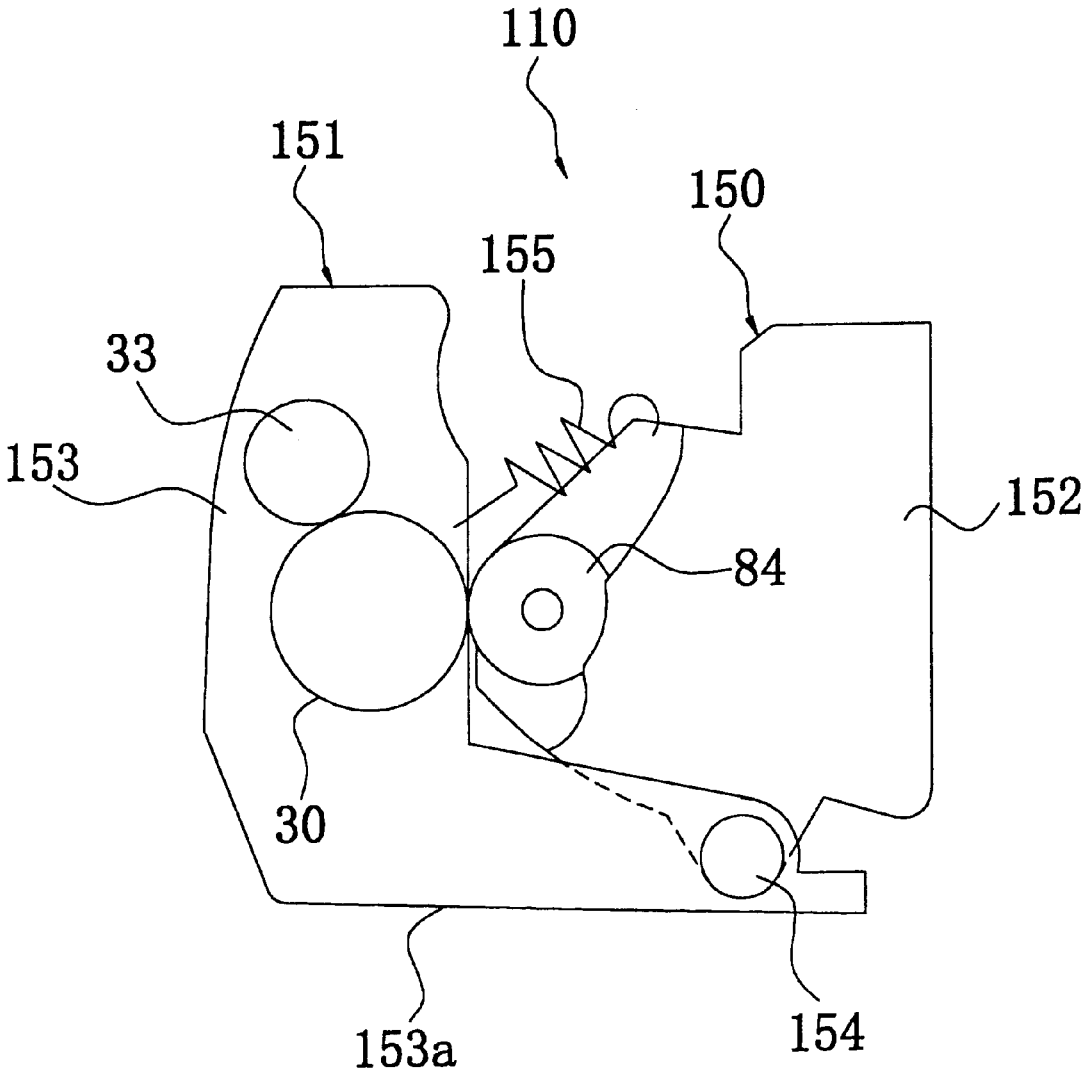
FIG. 13 is schematic elevational view of a casing of the imaging unit in yet another embodiment.

In the casing thus configured, the bottom surface 153*a* of the second framework 153 is made planar, and wherein the imaging unit 110 is withdrawn from the photocopier main body and the bottom surface 153*a* is set on a table, the posture shown in FIG. 13, that is, the state in which the imaging unit 110 is housed within the photocopier, is maintained.

Likewise as in the foregoing, for the example illustrated in FIG. 13, providing ribs, or otherwise providing protrusions, on the bottom surface of the first framework 153, configures the imaging unit 110 casing such that wherein it is set on a table or the like, a posture equivalent to that wherein the imaging unit 110 is housed in the photocopier 1 is maintained.

Various details of the present invention may be changed without departing from its spirit nor its scope. Furthermore, the foregoing description of the embodiments according to the present invention are provided for illustration only, and not for the purpose of limiting the invention as defined by the appended claims and their equivalents.

What is claimed is:

1. An imaging unit installable into and detachable from a predetermined position in an image reproducing apparatus, the imaging unit comprising:

a photosensitive drum for forming of electrostatic latent images circumferentially thereon;

a developing device for developing electrostatic latent images on said photosensitive drum into toner images; and a casing for housing said photosensitive drum and said developing device, said casing installable into and detachable from the predetermined position in the image reproducing apparatus, said casing being in a predetermined orientation when the imaging unit is installed in the predetermined position, wherein said casing is fitted with at least one collapsible talon member for maintaining the imaging unit in a posture equivalent to the predetermined orientation when said casing is removed from the image reproducing apparatus.

2. An imaging unit installable into and detachable from a predetermined position in an image reproducing apparatus, the imaging unit comprising:

a photosensitive drum for forming of electrostatic latent images circumferentially thereon;

a developing device containing developing agents for developing electrostatic latent images on said photosensitive drum into toner images, said developing device including a replaceable toner cartridge;

a cleaning device associated with a recovered toner transport device for cleaning off toner and developing agents residual on the photosensitive drum and returning the toner and developing agents to the developing device; and a casing installable into and detachable from the predetermined position in the image reproducing apparatus, said casing for housing said photosensitive drum such that said photosensitive drum is associated with a transfer device co-operational with said imaging unit when the imaging unit is installed into said predetermined position, and such that part of said photosensitive drum is exposed when the imaging unit is detached from said predetermined position;

said casing being configured with support means including an at least partially horizontal bottom support surface, such that when the imaging unit is removed from the image reproducing apparatus and set on a substantially horizontal surface, said casing maintains the imaging unit in a posture equivalent to the predetermined orientation, wherein the exposed part of said photosensitive drum is held away from the substantially horizontal surface, and the toner and developing agents in said cleaning device and said developing device are held in their steady state.

3. An imaging unit as set forth in claim 2, wherein said support means is bottom-surface ribs formed unidirectionally on said casing.

4. An imaging unit as set forth in claim 2, wherein said support means is a bottom-surface projection formed on said casing.

5. An imaging unit as set forth in claim 2, wherein said casing is configured to establish the imaging unit center of gravity such that the imaging unit is maintained by said casing in the posture equivalent to the predetermined orientation when said casing is removed from the image reproducing apparatus.

6. An imaging unit as set forth in claim 2, wherein said casing further includes at least one guided element for engagement with a corresponding guide provided in the image reproducing apparatus.

7. An imaging unit as set forth in claim 2, functional in an image reproducing apparatus employing a laterally disposed transfer device together with a vertically situated sheet transport path for transferring the toner images on said photosensitive drum onto sheets, wherein said casing is configured to position said photosensitive drum for lateral image transfer.

8. An imaging unit as set forth in claim 2, wherein said casing is formed from a framework for housing said developing unit, and for housing and meanwhile partially supporting said photosensitive drum therein.

9. An imaging unit as set forth in claim 2, wherein said toner cartridge is configured such that toner remaining inside said toner cartridge does not spill therefrom when withdrawing said toner cartridge from the imaging unit removed from the image reproducing apparatus.

* * * * *